United States Patent [19]

Gillson

[11] Patent Number: 5,022,667

[45] Date of Patent: Jun. 11, 1991

[54] MULTIPLE CONFIGURATION SEATING DEVICE

[76] Inventor: Robert K. Gillson, P.O. Box 8, Pillager, Minn. 56473

[21] Appl. No.: 419,736

[22] Filed: Oct. 11, 1989

[51] Int. Cl.[5] ..... A63G 17/00

[52] U.S. Cl. ..... 280/1.188; 280/7.12; 272/52.5

[58] Field of Search ..... 280/1.13, 1.188, 1.189, 280/1.22, 7.12, 26; 272/52.5, 52

[56] References Cited

U.S. PATENT DOCUMENTS

| | | | |
|---|---|---|---|
| 1,431,214 | 10/1922 | Burgess | 272/52.5 |
| 2,429,213 | 10/1947 | Bennett | 272/52.5 X |
| 2,541,327 | 2/1951 | Billinghurst | 280/1.188 X |
| 3,075,763 | 1/1963 | May | 272/52.5 |

FOREIGN PATENT DOCUMENTS

| | | | |
|---|---|---|---|
| 597000 | 8/1959 | Italy | 272/52.5 |
| 195294 | 3/1965 | Sweden | 272/52.5 |

*Primary Examiner*—Charles A. Marmor
*Assistant Examiner*—Alan M. Kager
*Attorney, Agent, or Firm*—Henry C. Kovar

[57] ABSTRACT

A seating device which is shown embodied in a hobby horse is easily changeable between a normal rocker configuration and a normal vehicular configuration. The device has a seat, a base with runners, a lock pedestal and a swivel pedestal connecting the seat to the base, and a lock mechanism to lock the seat to the pedestals in either of the configurations. The runners have wheels on one side and rocker surfaces on a second side. A method of changing the configuration is also provided.

20 Claims, 2 Drawing Sheets

FIG.3

MULTIPLE CONFIGURATION SEATING DEVICE

BACKGROUND OF THE INVENTION

1. Field of the Invention

This invention pertains to a seating device that can be changed between and locked into two functionally different configurations, one of which has a fixed attitude and the other of which is a rocker.

2. The Prior Art

Single attitude and adjustable attitude seating devices are well known; some of these are collapsible. Rocking chairs and rocking horses are also well known. Children's pull toys having wheels and a child's seat are also well known.

However when a rocking type hobby horse, and a pull type hobby horse are wanted, it has been necessary to acquire two discrete devices.

OBJECTS OF THE INVENTION

It is an object of this invention to provide a seating device that is lockable in two functionally different configurations.

It is an object of this invention to provide a hobby horse type device that is lockable in either of a wheeled or rocker configuration.

It is an object of this invention to provide a new method of changing and locking a seating device in either of two functionally different configurations.

SUMMARY OF THE INVENTION

A multiple configuration seating device has a seat, a base with a pair of elongate runners, a pair of opposed sides on each runner with a first side having fixed attitude structure and a second side having rocker surfaces, pivot structure connecting the seat to the base and enabling the seat to be pivoted past one end of the base, and lock structure for locking the seat in position on either side of the base.

A hobby horse type device has a seat, a base with a pair of elongate runners, a wheeled side and a rocker side on each runner, first and second seat pedestals pivotally connected to the runners, a seat swivel between the seat and one pedestal, and lock structure for locking the seat and the pedestals in either of two normal positions.

A method of fixing a seating device in either of two configurations has the steps of providing a base with runners housing a rocker surface on one side and wheels on the other side, unlocking the seat from a pair of pedestals pivotally attached to the base, pivoting the pedestals in between the runners from one side of the runners, swiveling the seat about one of the pedestals, and re-locking the seat to the pedestals.

DESCRIPTION OF THE PREFERRED EMBODIMENT

Figure 1:
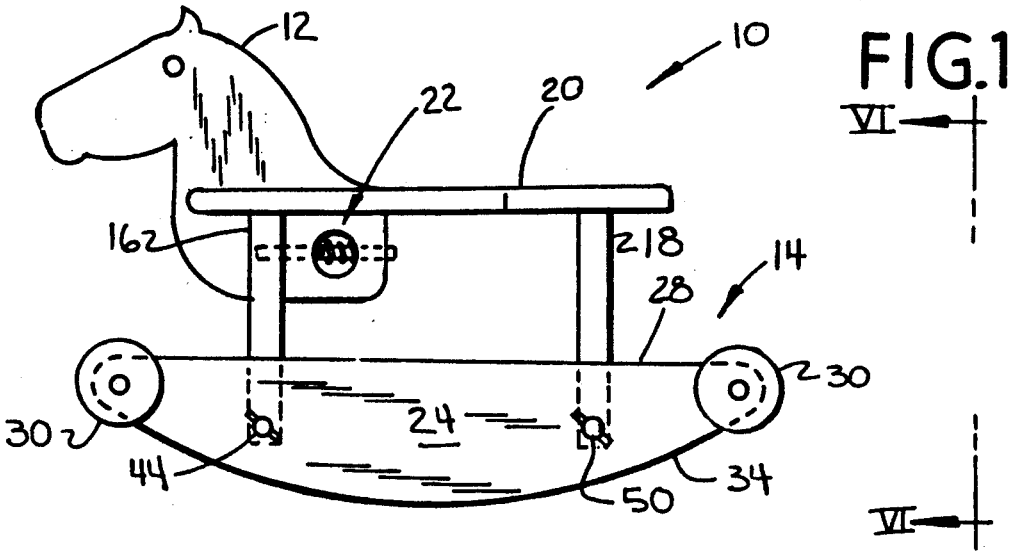
FIG. 1 is a side elevational view of the preferred embodiment of the present invention, shown in a rocker configuration.

According to the principles of the present invention, the preferred embodiment of a multiple configuration seating device is shown in FIGS. 1, 2, 3 and 4 and is generally indicated by the numeral 10. A preferred embodiment of the device 10 is a hobby horse configuration that has a handle head 12 with a profile that resembles a horse. Other configurations are also viable; a replication of a school bus being one alternative. The device 10 also has a base 14, seat pedestals 16, 18, a seat 20 and a seat lock 22.

Figure 2:
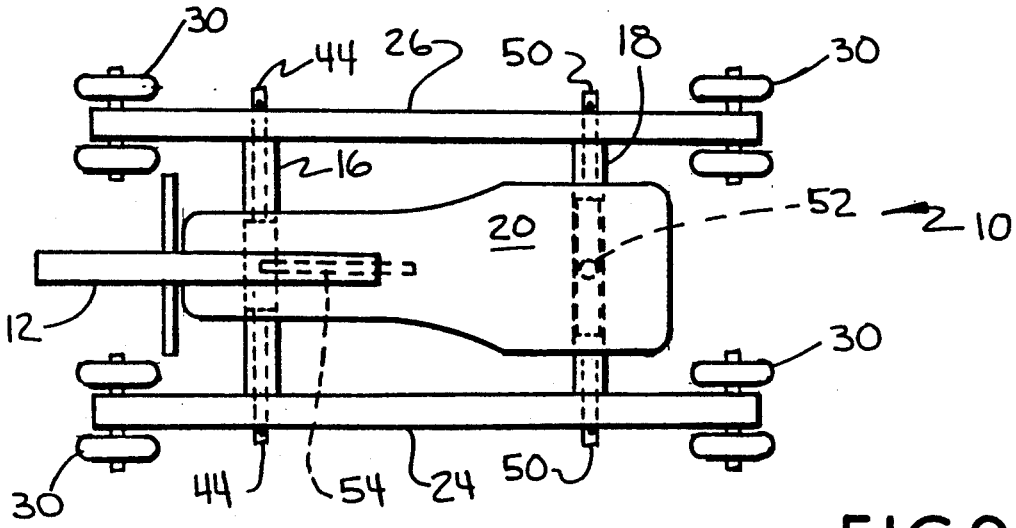
FIG. 2 is a top plan view of the structure of FIG. 1.
Figure 3:
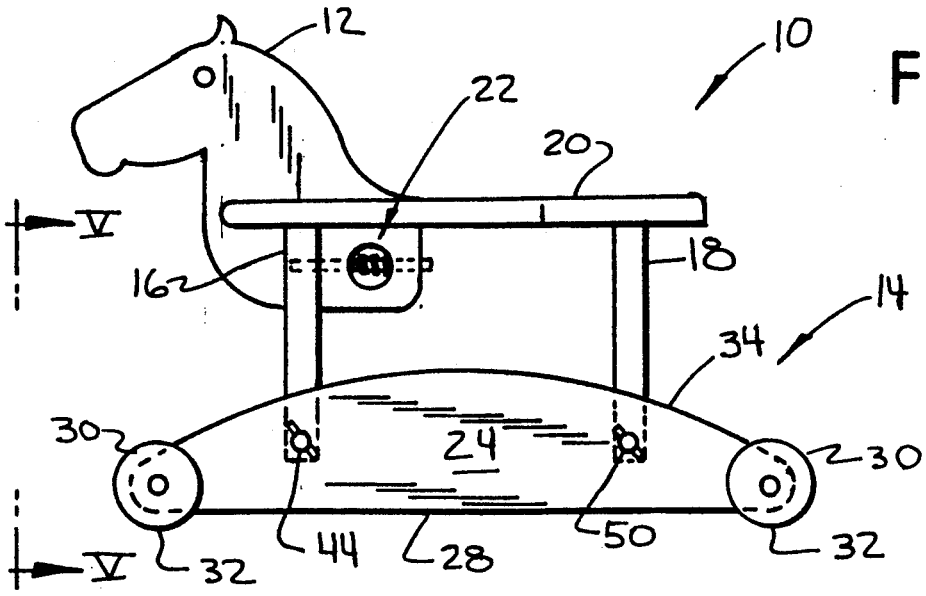
FIG. 3 is a side elevational view of the structure of FIG. 1, now shown in wheeled configuration.

The base 14 has a pair of elongate runners 24, 26 which are identical to each other and which are transversely spaced apart a distance which is greater than the width of the seat 20 as shown in FIG. 2. Each runner 24, 26 has a first side 28 which is generally flat and has a pair of wheels 30 that have ground contact points 32 providing a fixed attitude for the seat 20 and for the device 10 as best shown in FIG. 3. When the first side 28 and wheels 30 face downward as shown in FIG. 3, the device 10 can be pushed and/or pulled as a rolling vehicle. Each runner 24, 26 also has an opposed second side 34 which is a convex radiused rocker surface that when facing downward, as shown in FIG. 1, configures the device 10 as a rocker and provides for rocking motion of the device 10 and the seat 20.

An important feature of this invention is that it can quickly and easily be configured either as a rocker as shown in FIG. 1 or as a wheeled vehicle as shown in FIG. 3. If the runners 24, 26 were provided with runners and/or blades, the device 10 would be a sled that can also be pushed and/or pulled.

Figure 4:
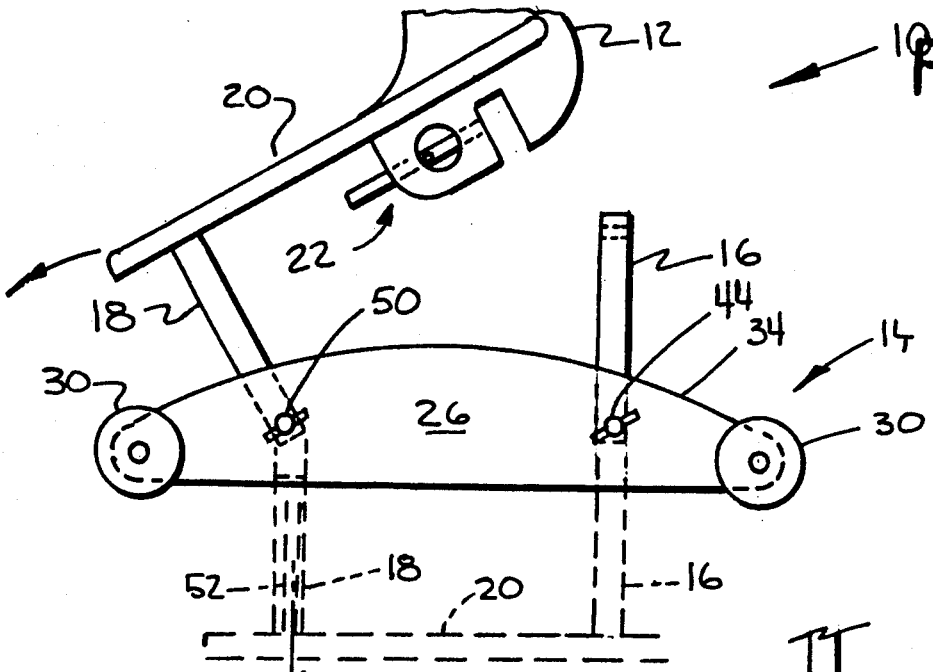
FIG. 4 is a side elevational view showing changing of the structure between the configurations of FIGS. 1 and 3.

The seat 20 is atop of and is supported by the pedestals 16, 18. The front pedestal 16 is secured to the front of the seat 20 and the rear pedestal is secured to rear of the seat 20. One of the pedestals 16, 18 is always connected to the seat 20 and the other of the pedestals 16, 18 is normally locked to but can be easily unlocked and disconnected from the seat 20 with the lock mechanism 22 as is shown in FIG. 4.

Figure 5:
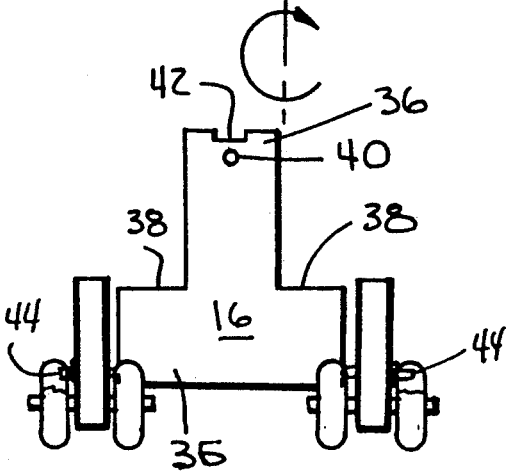
FIG. 5 is an elevational view from lines V—V in FIG. 3.

The lock pedestal 16 as best seen in FIG. 5 is a single planar member having a full width lower section 35, a narrowed upper neck 36, horizontal surfaces 38 that can be used as footrests by a toddler, a lock aperture 40, and a seat rest 42. The lock pedestal 16 is pivotally fastened to the runners 24, 26 by a pivot pin 44. The lock pedestal 16 is pivotable in between the runners 24, 26 outwardly at least 180 degrees between the two normal positions shown in FIGS. 1 and 3.

Figure 6:
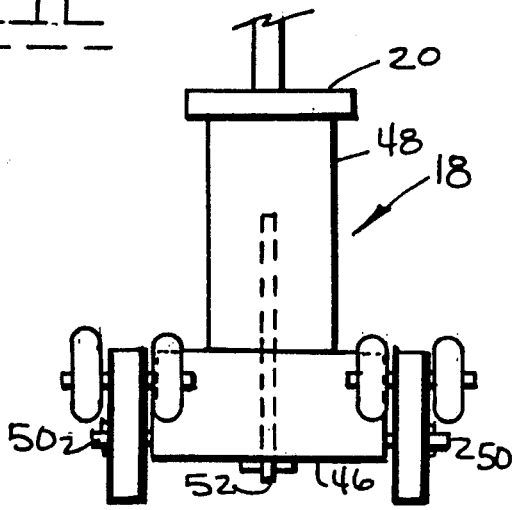
FIG. 6 is an elevational view from lines VI—VI in FIG. 1.

The swivel pedestal 18 shown best in FIG. 6, has a full width lower section 46, and a narrowed upper neck 48 fastened to the seat. The lower section 46 is pivotally fastened to the runners 24, 26 by a second pivot pin 50. The swivel pedestal 18 with the seat 20 fastened to it is pivotal (when unlocked) past its end of the base 14 at least 180 degrees and between the two normal positions shown in FIGS. 1 and 3. An important feature is the swivel pedestal is a swivel joint between the seat and the second pivot pin 50. The swivel joint is formed by the discrete lower section 46 and upper neck 48 being held to other by a swivel pin 52. The swivel pin 52 is preferably co-planar with but normal to the second pivot pin 50.

The pivot pins 44, 50 secure the two runners 24, 26 together and to the pedestals 16, 18. The wheels 30 preferably extend outward over and beyond the rocker surface 34 to provide rocker safety stops that limit both backwards and forward rocking motion.

Figure 7:
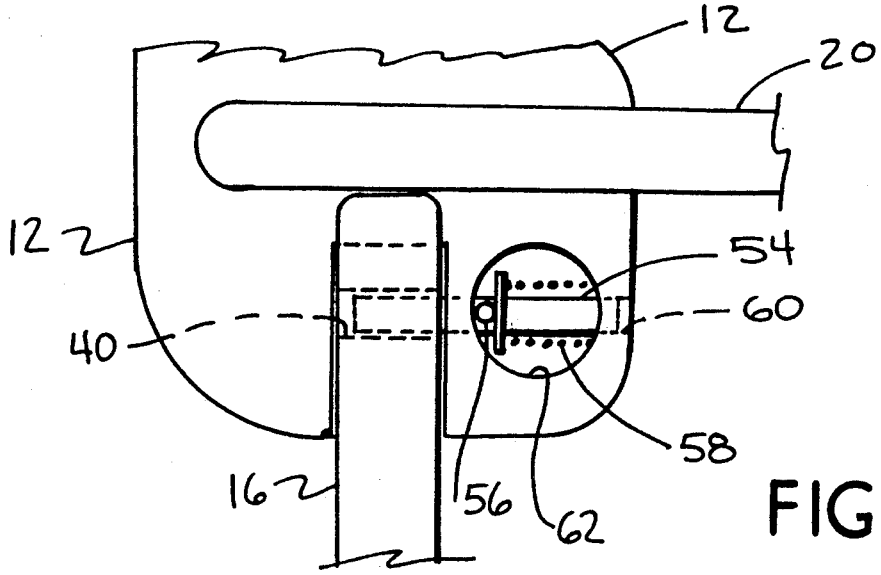
FIG. 7 is a side elevational detail view of the lock mechanism.

The lock mechanism 22 shown in detail in FIG. 7, has a lock shaft 54 with a crosspin and actuator 56 resiliently biased by a lock spring 58 into the lock aperture 40. the lock mechanism 22 is preferably structured inside the handle head 12 within a slide bore 60 and an access bore 62.

In the operation and use of the device 10, and in the practice of method of this present invention, it is apparent that, as previously described, the device 10 is used as a rocker when in the configuration of FIG. 1 and as a wheeled, bladed or skidded push/pull vehicle when configured as shown in FIG. 3. Both of the configurations of FIGS. 1 and 3 are normal.

To change the device between the two normal configurations, the normally closed lock mechanism 22 is open and the seat 20 is lifted up as shown in FIG. 4. The lock pedestal 16 is then pivoted from the position shown in solid lines to the position shown in dotted lines, at the same time the swivel pedestal 18 and seat 20 are pivoted past the other end to the position shown in dotted lines. The seat 20 is then swiveled 180 degrees about the swivel pin 52 and the lock mechanism 22 is relocked and closed upon the lock pedestal 16.

The entire device 10 can be built from wood and can be marketed as a completed device or a kit for end user assembly. The entire device 10 can also be mass produced using conventional plastic materials and techniques. The device 10 is safe and can easily be configured and changed without the use of tools; the configuration change can easily be done by a pre-school child user. However the lock mechanism 22 is completely under and is covered by the seat 20 and is not accessible during use of the device 10 so that accidental collapse while in use is virtually impossible.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A multiple configuration seating device, comprising (a) a seat having a width and a length:

(b) a base having a pair of elongate runners which are transversely spaced apart from each other;

(c) a pair of opposed sides on each runner, a first of said sides having ground contact means for supporting said seat in a fixed attitude, a second of said sides having a convex rocker surface for rocking support of said seat;

(d) pivot means pivotally connecting and securing said seat to said base for enabling said seat to be pivoted in between said runners and past one end of said base while said seat is secured to said base; and (e) lock means for locking said seat in a first position facing said first runner sides for configuration of said device as a rocker, and in a second position facing said second runner sides for configuration of said device as a fixed attitude seat.

2. The device of claim 1 in which said ground contact means comprise at least two wheels on each runner, said wheels being longitudinally outside of said seat securing pivot means and said lock means.

3. The device of claim 1, in which said pivot means structurally secures said runners to each other and to said seat.

4. The device of claim 3, in which said pivot means spaces said runners from each other, said secured seat from said runners.

5. The device of claim 1, in which said pivot means includes swivel means for swiveling said secured seat with respect to the runners while said seat remains secured to said base.

6. The device of claim 5, in which said swivel means is normal to said pivot means.

7. The device of claim 5, including a pair of spaced apart and generally parallel upright pedestals supporting said seat above said runners, said pedestals being pivotable about said pivot means, one of said pedestals having said seat securing swivel means therein.

8. The device of claim 1, in which said lock means is a resiliently biased pin secured to said seat and connected to a generally vertical lock pedestal, said lock pedestal being pivotally connected to said runners.

9. A hobby horse type device comprising (a) a seat having a width, a length, and a handle head;

(b) a base having a pair of elongate runners which are transversely spaced apart from each other;

(c) a pair of opposed sides on each runner, a first of said sides having wheels, a second of said sides having convex rocker surfaces;

(d) first and second seat pedestals positioned in between said runners, said pedestals being pivotally connected to said runners by transverse pivot pins, said pedestals and said seat being pivotal in between said runners and between two normal positions the first of which extends upward from first runner sides and the second of which extends upward from the second runner sides;

(e) a seat swivel in one of said pedestals, said swivel securing said seat to said runners; and (f) lock means for locking said pedestals and said seat in either of said normal positions.

10. The device of claim 9, in which said wheels are longitudinally positioned at least partially outside of said runners, said pedestals and said seat swivel.

11. The device of claim 9, in which said wheels have a portion projecting outward beyond said rocker surfaces to form rocker safety stops.

12. The device of claim 11, in which said wheels are in the ends of said runners.

13. The device of claim 9, in which said first pedestal is a swivel pedestal permanently fastened to said seat, and in which said second pedestal is a locking pedestal which is unlockable from the seat.

14. The device of claim 13, in which said pedestals and said seat pivot inbetween and past the ends of the runners.

15. The device of claim 13, in which said swivel pedestal has a lower section connected to the runner, an upper neck connected to the seat, and a swivel pin connecting the lower section and the upper neck, said seat being fixedly secured to said upper neck.

16. The device of claim 15, including a transverse pivot pin connecting the lower section to the runners, said pivot pin and said swivel pin being normal to each other.

17. The device of claim 9, in which said lock means is a resiliently biased pin positioned directly under and covered by said seat.

18. The device of claim 9, in which said pedestals are generally parallel to each other and normal to said seat, said lock means being resiliently biased into a locked configuration.

19. A method of fixing a seat device in either of two configurations comprising the steps of (a) providing a base having runners with a rocker surface on one side and wheels on the other side;

(b) unlocking a permanently secured seat from a first one of a pair of pedestals pivotally attached to said base;

(c) pivoting the pedestals and the seat in between the runners from one side of the runners to the other side of the runners while the seat remains secured to a second one of the pedestals;

(d) swiveling the secured seat above second said pedestal; and (e) re-locking the seat to the pedestals.

20. The method of claim 19, in which the unlocking and re-locking is done with a resiliently biased lock pin underneath the seat.

* * * * *